US010784621B1

(12) United States Patent
Pusch et al.

(10) Patent No.: US 10,784,621 B1
(45) Date of Patent: Sep. 22, 2020

(54) CONNECTOR HOUSING LATCH

(71) Applicant: LEAR CORPORATION, Southfield, MI (US)

(72) Inventors: Reinhard Pusch, Farmington Hills, MI (US); Yefim Grinshpun, Southfield, MI (US); David Menzies, Linden, MI (US); Anthony Butcher, Troy, MI (US); Bhupinder Rangi, Novi, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/601,728

(22) Filed: Oct. 15, 2019

(51) Int. Cl.
*H01R 13/627* (2006.01)
*H01R 13/50* (2006.01)

(52) U.S. Cl.
CPC ..... *H01R 13/6272* (2013.01); *H01R 13/501* (2013.01); *H01R 13/627* (2013.01)

(58) Field of Classification Search
CPC ..... H01R 13/6271; H01R 13/6272; H01R 13/6273; H01R 13/501; H01R 13/627; H01R 13/62966; H01R 13/62977
See application file for complete search history.

(56) References Cited

U.S. PATENT DOCUMENTS 3,933,406 A * 1/1976 Cameron ..... H01R 13/6273 439/358
4,441,776 A * 4/1984 Anhalt ..... H01R 13/6272 439/266
5,547,388 A 8/1996 Hill
5,672,071 A * 9/1997 Ceru ..... H01R 13/6272 439/352
5,997,334 A 12/1999 Goto

FOREIGN PATENT DOCUMENTS

GB 2311420 A * 9/1997 ..... H01R 13/6272

* cited by examiner

*Primary Examiner* — Nguyen Tran
*Assistant Examiner* — Paul D Baillargeon
(74) *Attorney, Agent, or Firm* — MacMillan, Sobanski & Todd, LLC

(57) ABSTRACT

An electrical connector includes a connector housing having a first end and an opposed second end, a pair of release stops extending generally radially outward and adjacent to the first end, and a pair of deflection buttons extending longitudinally cantilevered from a pivot base having a lateral axis and having free ends extending toward the first end and located adjacent to and radially outward from respective ones of the release stops when in an unflexed state. The electrical connector also includes a latch arm extending longitudinally cantilevered from the pivot base toward the second end, with a free end of the latch arm including a latch lock configured to selectively engage a barb on a mating connector.

16 Claims, 6 Drawing Sheets

CONNECTOR HOUSING LATCH

BACKGROUND OF THE INVENTION

The present invention relates to a connector housing, and in particular to a latch for a connector housing used in an electrical connector assembly.

Electrical connector assemblies that mate multiple wire harnesses often include a pair of housings that are releasably mated to each other. Once mated together, some type of latch or other securement mechanism (lock) may hold the housings together to prevent inadvertent release of the housings from each other. To allow for repair or replacement, the housings may include some type of release for the lock that allows the housings to be separated. However, it is undesirable for the release to be easily inadvertently actuated, in which case the housings may be separated when not desired.

SUMMARY OF THE INVENTION

An embodiment contemplates an electrical connector comprising a connector housing having a first end and an opposed second end, a pair of spaced apart release stops extending generally radially outward and adjacent to the first end, a single or a pair of deflection buttons extending longitudinally cantilevered from a pivot base having a lateral axis and having free ends extending toward the first end and located adjacent to and radially outward from respective ones of the release stops when in an unflexed state, and a latch arm extending longitudinally cantilevered from the pivot base toward the second end, with a free end of the latch arm including a latch lock configured to selectively engage a barb on a mating connector. An embodiment contemplates an electrical connector comprising: a connector housing having: a first end and an opposed second end; a pair of spaced apart release stops extending generally radially outward and adjacent to the first end; a pivot base pivotable about a generally lateral axis; a pair of deflection buttons extending longitudinally cantilevered from the pivot base and having free ends extending toward the first end and located adjacent to and radially outward from respective ones of the release stops when in an unflexed state; and a latch arm extending longitudinally cantilevered from the pivot base toward the second end, with a free end of the latch arm including a latch lock; and a mating connector having: a mating housing with a first end configured to be received in the connector housing; and a barb extending radially outward from the mating housing and configured to selectively engage the latch lock.

An advantage of an embodiment is that the latch for the connector housing is not disengageable or unlockable from the other housing by just pressing on the latch button but is when also actuating deflection buttons.

DETAILED DESCRIPTION

Figure 1:
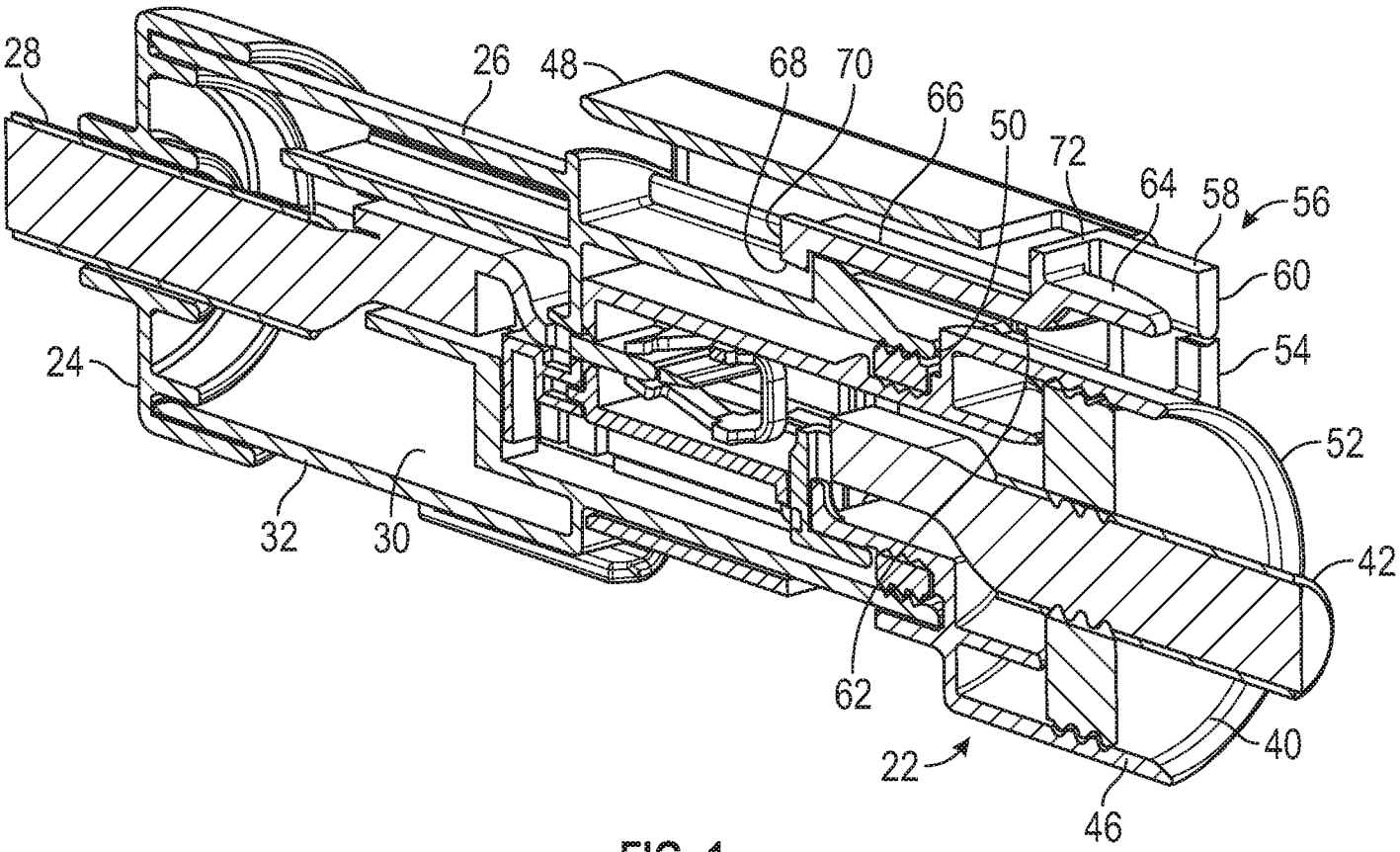
FIG. 1 is a schematic perspective view, in cross section, of a connector assembly.
Figure 2:
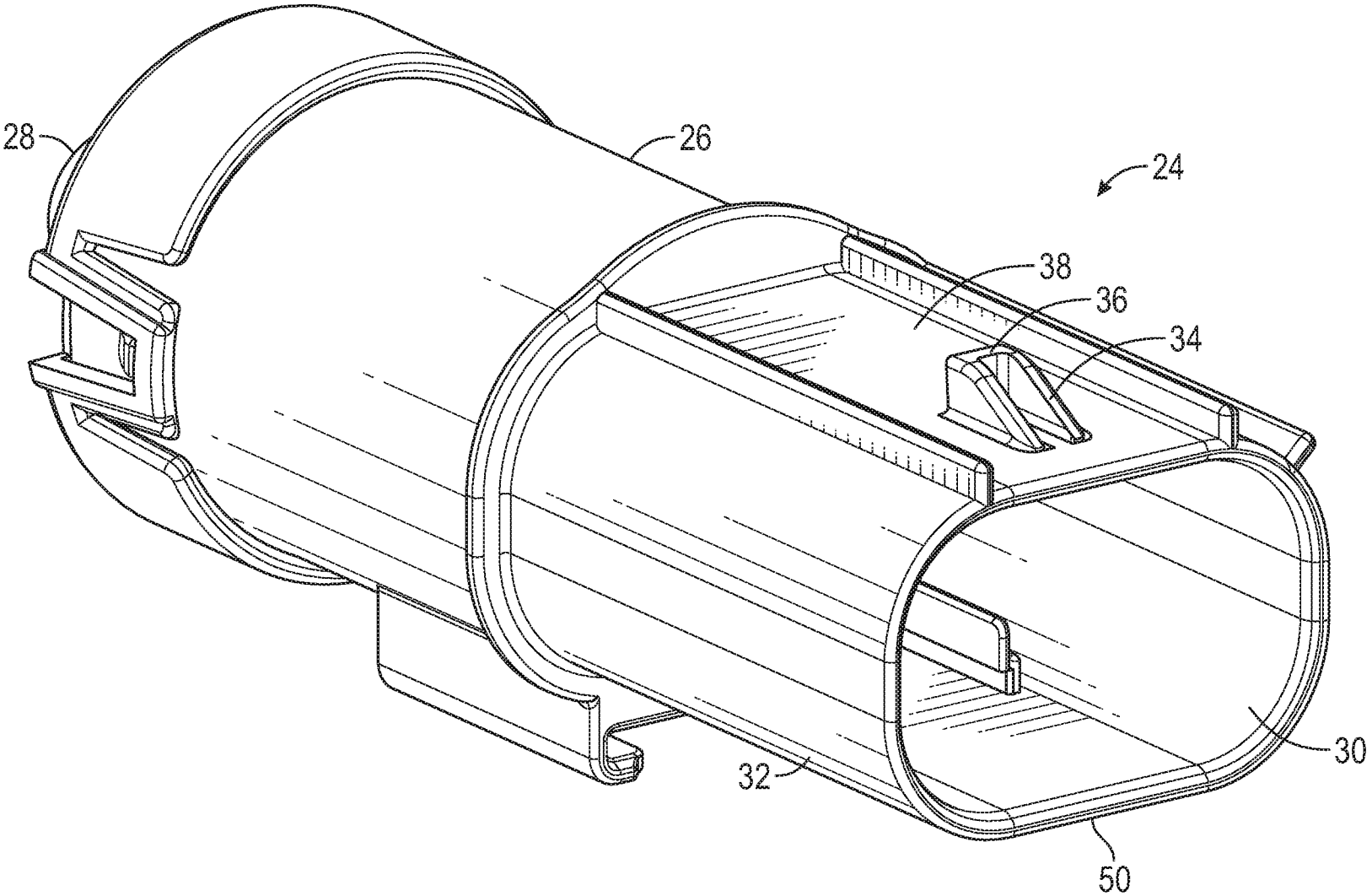
FIG. 2 is a schematic perspective view of a mating connector.
Figure 3:
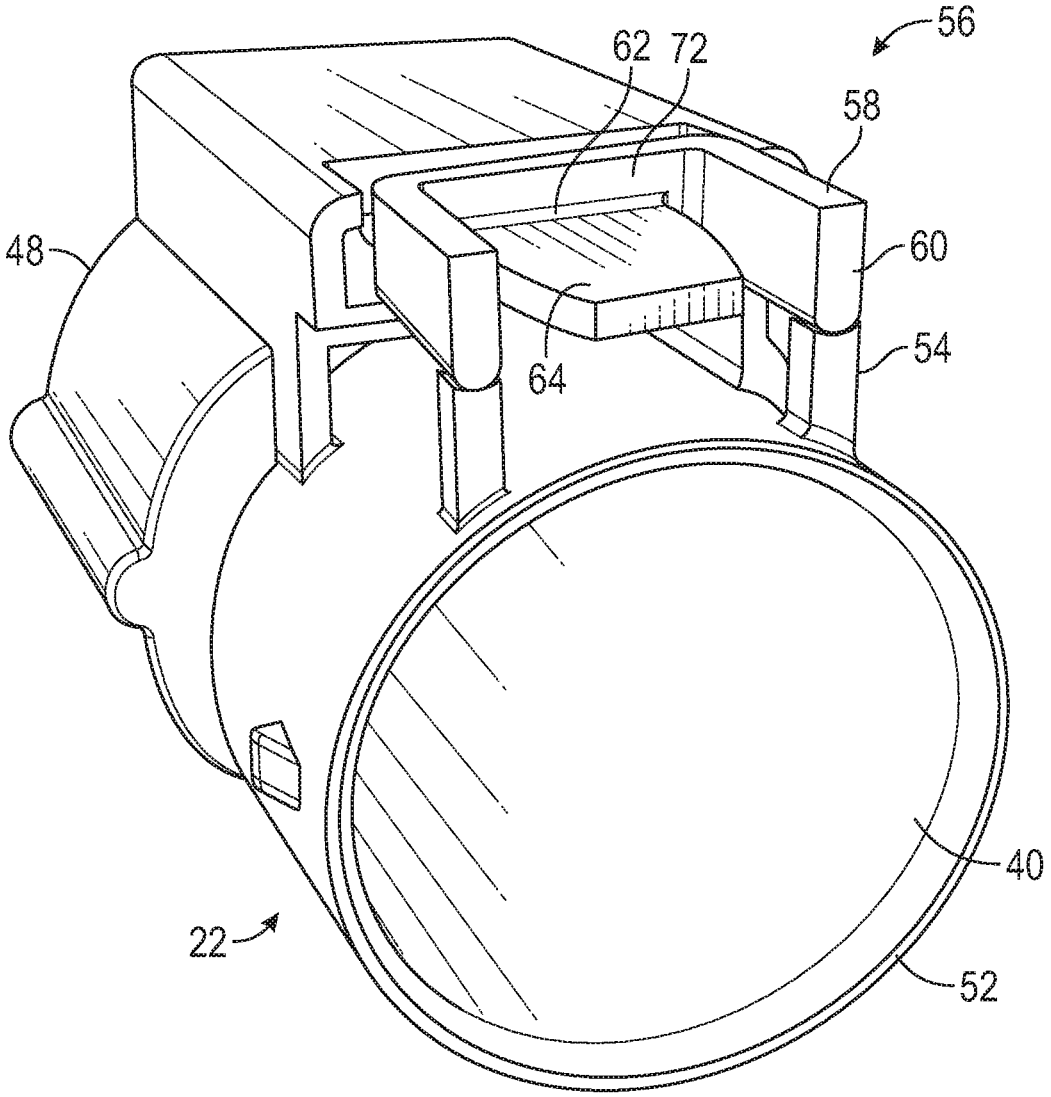
FIG. 3 is a schematic perspective view of a connector housing.
Figure 4:
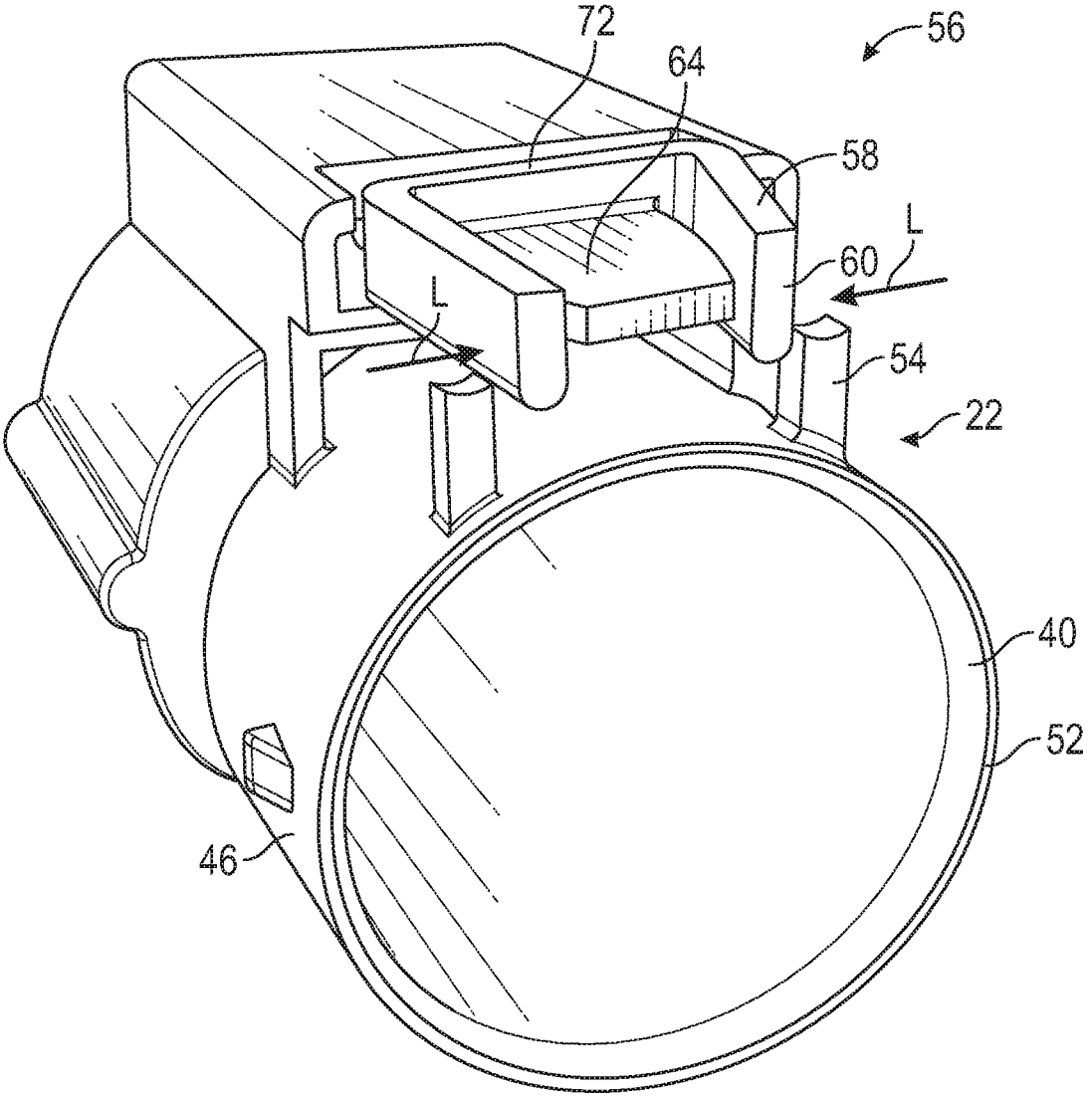
FIG. 4 is a schematic perspective view of the connector housing, with the deflector buttons actuated laterally inward.
Figure 5:
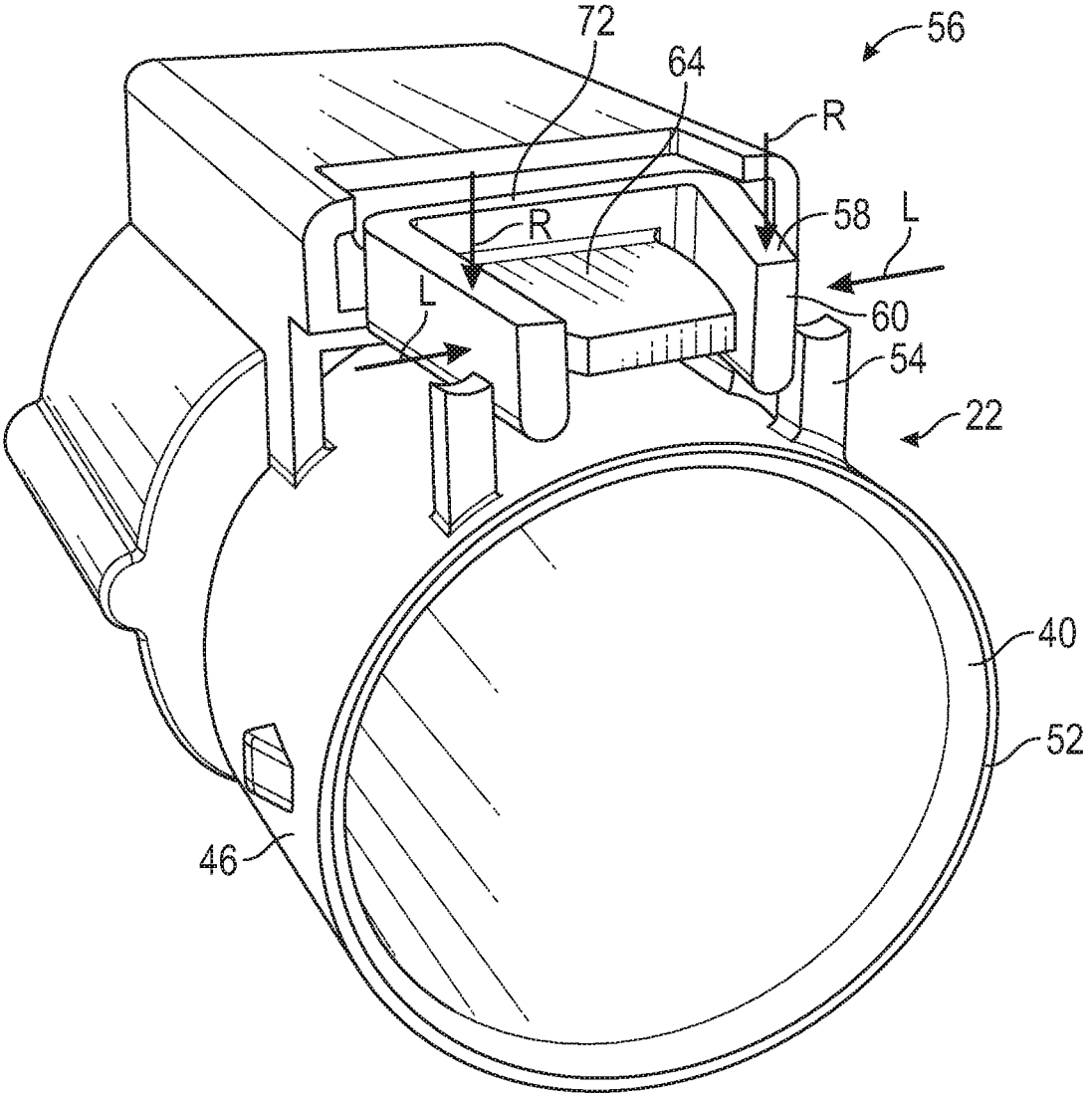
FIG. 5 is a schematic perspective view of the connector housing, with the deflector buttons actuated laterally inward and pivoted radially inward.

FIGS. 1-5 illustrate various portions of a connector assembly 20, which includes a connector housing 22 that is selectively secured to a mating connector 24. The connector housing 22, is formed from an elastic material that allows for flexing (deflection) when a force is applied and then returns to the non-deflected state when the force is released.

The mating connector 24 includes a mating housing 26 that may contain mating electrical components 28 within a connector receiving passage 30 that is defined by a mating main body 32. A pair of ramps 34 extend generally radially outward from an outer surface 38 of the mating main body 32 and terminate at a barb 36. The ramps 34 slope radially inward toward the end 50 of the mating main body 32 that is received in an electrical passage 40 of the connector housing 22.

The connector housing 22 may include electrical components 42 that are received in the electrical passage 40, which is defined by a housing main body 46. The housing main body 46 has a first end 48, which is slideable around the end 50 of the mating main body 32, and a second end 52, longitudinally opposite from the first end 48. Extending generally radially outward from the housing main body 46, adjacent to the second end 52 are a pair of spaced apart release stops 54. The release stops 54 interact with a latch 56, which selectively secures and releases the mating connector 24 to and from the connector housing 22. The latch 56 may be molded as part of the connector housing 22, the two thus being formed as a single monolithic piece.

The latch 56 includes a singular or pair of deflection buttons 58 that extend cantilevered from the housing main body 46 in a generally longitudinal direction toward the second end 52. The deflection buttons 58 are located such that free ends 60 longitudinally and laterally align with respective release stops 54, radially outward and adjacent to the respective release stops 54. This location of the deflection buttons 58 occurs when the buttons 58 are in their non-deflected (un-flexed) state. Thus, in the non-deflected state, the deflection buttons 58 cannot move radially inward.

The latch 56 also includes a pivoting beam 62 with two opposed cantilevered members, a latch tongue 64 and a latch arm 66. The latch tongue 64 extends cantilevered from the housing main body 46 in a generally longitudinal direction toward the second end 52, generally parallel to and generally between the deflection buttons 58. The latch arm 66 extends generally longitudinally, cantilevered in an opposite direction from the latch tongue 64. The latch arm 66 includes a latch lock 68 extending radially inward from a free end 70 of the latch arm 66, with the free end 70 extending toward the first end 48 of the housing main body 46. The latch lock 68 is sized and located such that, as the mating connector 24 is slid into the connector housing 22, the latch lock 68 slides up the ramps 34 and engages the barb 36 when the mating connector 24 is fully seated in the connector housing. The latch lock 68 may taper somewhat toward the free end 70 in order to assist in the sliding motion during assembly.

One will note that the deflection buttons 58 and pivoting beam 62 (latch tongue 64 and latch arm 66) all pivot about essentially the same pivot base 72 (best seen in FIG. 1), which pivots about a laterally extending axis. Thus, for example, if the free ends 60 of the deflection buttons 58 are moved radially inward, this causes the pivot base 72 to pivot about this lateral axis, which in turn will cause the free end of the latch tongue 64 to also move radially inward while at the same time causing the free end 70 of the latch arm 66 to move radially outward.

The assembly and disassembly of the connector assembly 20 will now be discussed. When one wishes to assemble the connector housing 22 to the mating connector 24, the two are oriented so that the first end 48 of the connector housing 22 will slide around the end 50 of the mating housing 26, with the latch arm 66 aligned with the ramps 34. The connector housing 22 and mating connector 24 are then slid telescopically toward each other. While sliding telescopically, the latch lock 68 will slide up the ramps 34, thus causing the latch arm 66 to flex radially outward. Upon essentially full insertion, the latch lock 68 slides off of the ramps 34, allowing the latch arm 66 to flex radially inward, engaging the latch lock 68 with the barb 36. The connector assembly 20 is now secured together (see FIG. 1).

When one wishes to disassemble the connector housing 22 from the mating connector 24, one must first disengage the latch lock 68 from the barb 36. To accomplish this, one grasps the deflection buttons 58 adjacent to the free ends 60 and flexes them laterally inward towards each other (see arrows L in FIG. 4, indicating the direction of applied lateral force). This flexing offsets the free ends 60 of the deflection buttons 58 from the release stops 54. While maintaining the lateral force L, the free ends 60 of the deflection buttons 58 are then pivoted, about the pivot base 72, radially inward (see arrows R in FIG. 5, indicating the direction of the applied radial force). Since the deflection buttons 58 are flexed laterally inward, the radially inward pivoting can now be accomplished without interference from the release stops 54. As the free ends 60 move radially inward, the latch tongue 64 also pivots radially inward, with the latch arm 66 pivoting to cause its free end 70 to move radially outward. This movement causes the latch lock 68 to move radially outward, out of engagement with the barb 36. Thus, the latch 56 on the connector housing 22 is disengaged from the barb 36 on the mating housing 26.

With the latch 56 disengaged, one continues holding the deflection buttons 58 laterally inward and radially downward and pulls the mating housing 26 telescopically from the connector housing 22. The connector assembly 20 is now disassembled. Upon releasing the deflection buttons 58, the features return to unflexed states. Accordingly, the housings 22, 26 are ready to be reassembled when desired.

Figure 6:
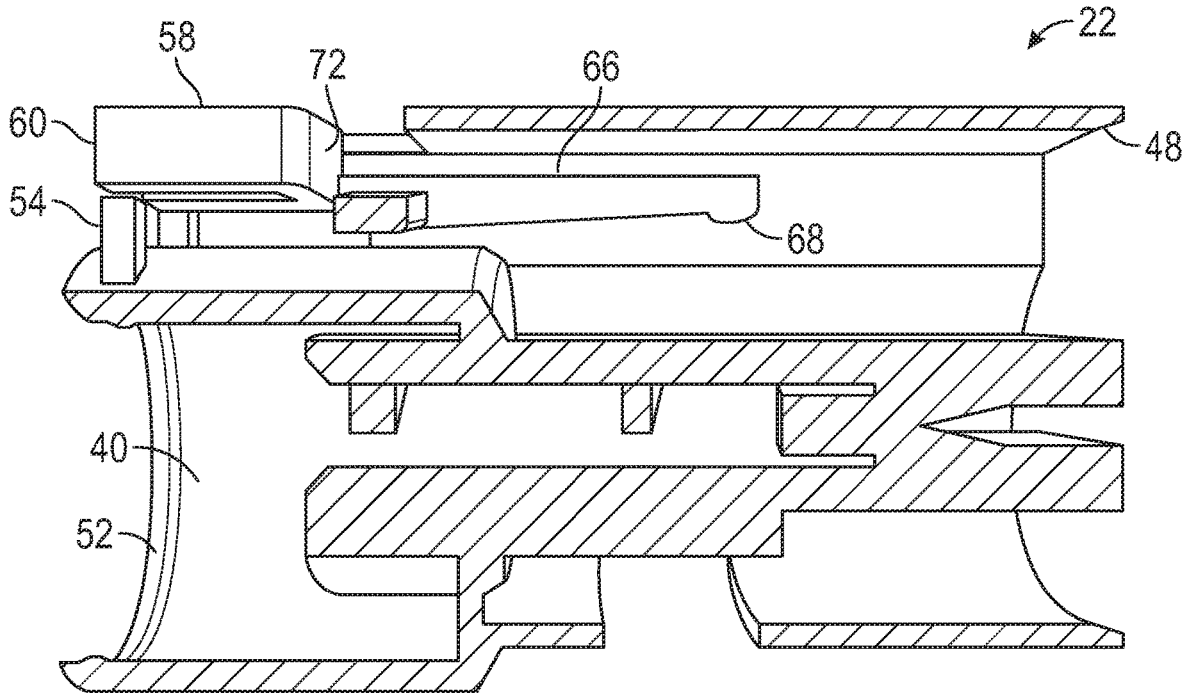
FIG. 6 is a schematic cross section of an alternative embodiment of the connector housing, in the un-deflected state.
Figure 7:
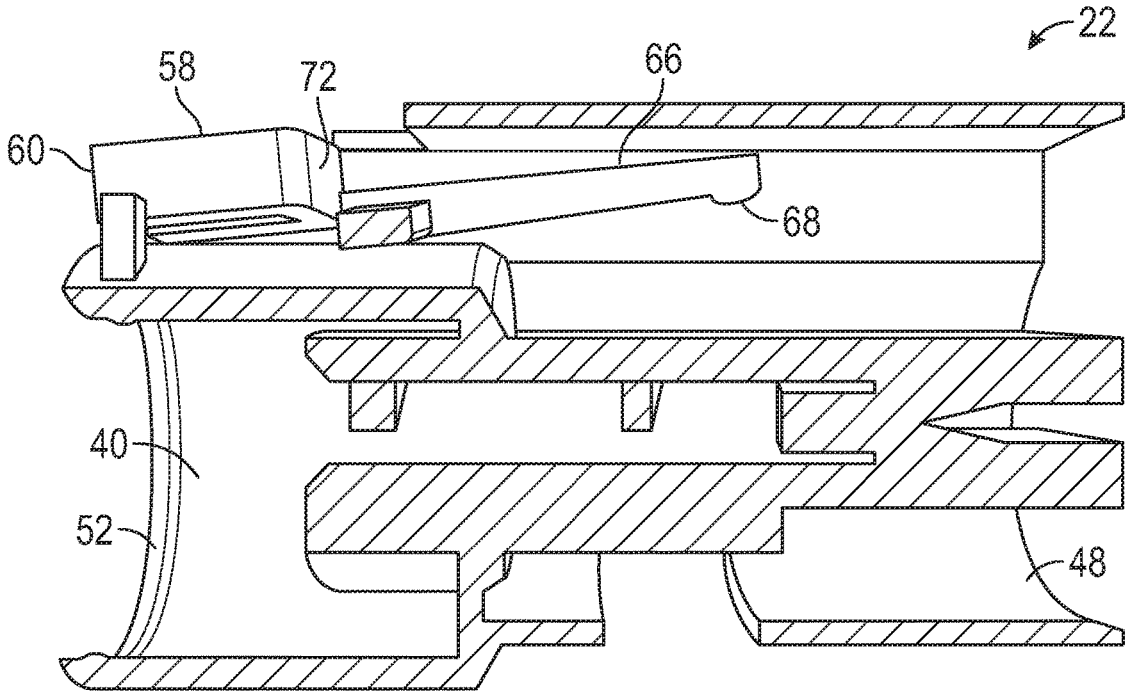
FIG. 7 is a schematic cross section similar to FIG. 6, but showing the deflector buttons actuated laterally inward and pivoted radially inward.

FIGS. 6-7 illustrate an alternate embedment of the connector housing 22. Since the apparatus described in this embodiment is a modification of the first embodiment, like reference characters designate corresponding elements of the drawings and detailed description thereof will be omitted. In this embodiment, the internal structure of the connector housing 22 is somewhat different, which may accommodate somewhat different electrical components (see 42 in FIG. 1). The latch lock 68 is still located at the end of the latch arm 66, which still pivots about the pivot base 72, from which the deflection buttons 58 extend in an opposite direction.

In FIG. 6, the deflection buttons 58 are unflexed and so align with the release stops 54, preventing the free ends 60 of the deflection buttons 58 from moving radially inward. Accordingly, the latch lock 68 is in a position to engage the barb of the mating housing (see FIG. 1).

In FIG. 7, one will note that the free ends 60 of the deflection buttons 58 are flexed laterally inward and radially inward, thus causing the latch lock 68 of the latch arm 66 to pivot radially outward. Accordingly, the latch lock 68 is in a position to remain released from the barb of the mating housing (see FIG. 1).

While certain embodiments of the present invention have been described in detail, those familiar with the art to which this invention relates will recognize various alternative designs and embodiments for practicing the invention as defined by the following claims.

The invention claimed is:

1. An electrical connector comprising:

a connector housing having a first end and an opposed second end; a pair of spaced apart release stops extending generally radially outward and adjacent to the first end; a pair of deflection buttons extending longitudinally cantilevered from a pivot base, which has a lateral axis, and having free ends extending toward the first end and located adjacent to and radially outward from respective ones of the release stops when in an unflexed state; and a latch arm extending longitudinally cantilevered from the pivot base toward the second end, with a free end of the latch arm including a latch lock configured to selectively engage a barb on a mating connector.

2. The electrical connector of claim 1 wherein the connector housing is made of an elastomeric material and the free ends of the deflection buttons are configured to be deflectable laterally inward away from the release stops and then radially downward to cause the free end of the latch arm to pivot radially outward.

3. The electrical connector of claim 1 including the mating connector having a mating housing with a first end configured to be received in the connector housing, the barb extending radially outward from the mating housing.

4. The electrical connector of claim 3 wherein the mating housing includes at least one longitudinally extending ramp, adjacent to the barb, and tapering radially downward toward the first end of the mating housing, the ramp configured to engage the latch lock and flex the latch arm radially outward as the mating housing is telescopically slid into the connector housing.

5. The electrical connector of claim 4 wherein the connector housing is made of an elastomeric material and the free ends of the deflection buttons are configured to be deflectable laterally inward away from the release stops and then radially downward to cause the free end of the latch arm to pivot radially outward out of engagement with the barb.

6. The electrical connector of claim 3 wherein the connector housing is made of an elastomeric material and the free ends of the deflection buttons are configured to be deflectable laterally inward away from the release stops and then radially downward to cause the free end of the latch arm to pivot radially outward out of engagement with the barb.

7. The electrical connector of claim 1 wherein the connector housing includes a latch tongue extending longitudinally cantilevered from the pivot base between the deflection buttons, the latch tongue spaced from the deflection buttons when in the unflexed state and laterally in contact with the deflection buttons when in a laterally inwardly deflected state.

8. The electrical connector of claim 1 wherein the connector housing, including at least the release stops, the deflection buttons, the pivot base, the latch arm and the latch lock are a single monolithic piece made of an elastomeric material.

9. The electrical connector of claim 8 wherein the free ends of the deflection buttons are configured to be deflectable laterally inward away from the release stops and then radially downward to cause the free end of the latch arm to pivot radially outward.

10. The electrical connector of claim 8 including the mating connector having a mating housing with a first end configured to be received in the connector housing, the barb extending radially outward from the mating housing.

11. The electrical connector of claim 10 wherein the mating housing includes at least one longitudinally extending ramp, adjacent to the barb, and tapering radially downward toward the first end of the mating housing, the ramp configured to engage the latch lock and flex the latch arm radially outward as the mating housing is telescopically slid into the connector housing.

12. An electrical connector comprising:

a connector housing having:

a first end and an opposed second end;

a pair of spaced apart release stops extending generally radially outward and adjacent to the first end;

a pivot base pivotable about a generally lateral axis;

a pair of deflection buttons extending longitudinally cantilevered from the pivot base and having free ends extending toward the first end and located adjacent to and radially outward from respective ones of the release stops when in an unflexed state; and a latch arm extending longitudinally cantilevered from the pivot base toward the second end, with a free end of the latch arm including a latch lock; and a mating connector having:

a mating housing with a first end configured to be received in the connector housing; and a barb extending radially outward from the mating housing and configured to selectively engage the latch lock.

13. The electrical connector of claim 12 wherein the connector housing is made of an elastomeric material and the free ends of the deflection buttons are configured to be deflectable laterally inward away from the release stops and then radially downward to cause the free end of the latch arm to pivot radially outward.

14. The electrical connector of claim 12 wherein the mating housing includes at least one longitudinally extending ramp, adjacent to the barb, and tapering radially downward toward the first end of the mating housing, the ramp configured to engage the latch lock and flex the latch arm radially outward as the mating housing is telescopically slid into the connector housing.

15. The electrical connector of claim 12 wherein the connector housing includes a latch tongue extending longitudinally cantilevered from the pivot base between the deflection buttons, the latch tongue spaced from the deflection buttons when in the unflexed state and laterally in contact with the deflection buttons when in a laterally inwardly deflected state.

16. The electrical connector of claim 12 wherein the connector housing, including at least the release stops, the deflection buttons, the pivot base, the latch arm and the latch lock are a single monolithic piece made of an elastomeric material.

* * * * *